US005195584A

United States Patent [19]

Basinger, Jr.

[11] Patent Number: 5,195,584

[45] Date of Patent: Mar. 23, 1993

[54] SEALING APPARATUS FOR REPAIRING BREACHES IN CASING

[76] Inventor: Albert E. Basinger, Jr., P.O. Box 749, Pawhuska, Okla. 74056

[21] Appl. No.: 703,810

[22] Filed: May 21, 1991

[51] Int. Cl.[5] ..... E21B 33/124

[52] U.S. Cl. ..... 166/191; 166/185

[58] Field of Search ..... 166/185, 188, 191, 202, 166/277

[56] References Cited

U.S. PATENT DOCUMENTS 4,258,788 3/1981 Patton et al. ..... 166/191 X 4,961,465 10/1990 Brandell ..... 166/202 X

*Primary Examiner*—William P. Neuder

*Attorney, Agent, or Firm*—Bill D. McCarthy; Glen M. Burdick; Nicholas D. Rouse

[57] ABSTRACT

An improved sealing is provided for repairing a breach of down hole casing integrity, while maintaining substantially unrestricted annular fluid communication through the length of the well bore which comprises a casing sleeve supported on a tubing string for providing an alternate liquid or gas flow route about the tubing string at the defective portion of the casing. The casing sleeve is disposed between and connected to a first and second seal support housing assembly, each of which has an internal bore and a retaining end portion dimensioned to prevent a tubing collar of the tubing string from passing therethrough. Resilient casing engaging members are supported on each of the first and second seal support housing assemblies such that the resilient casing engaging members provide an effective seal between the first and second seal support housing assemblies and an adjacently disposed internal wall of the casing. The first and second seal support housing assemblies also having fluid communication slots disposed between the resilient casing engaging members and the retaining end portion of the first and second seal support housing assemblies to provide substantially unrestricted annular fluid communication about the tubing string especially around tubing upset and collar which extends through the length of the well bore.

3 Claims, 3 Drawing Sheets

SEALING APPARATUS FOR REPAIRING BREACHES IN CASING

BACKGROUND OF THE INVENTION

1. Field of the Invention

The present invention relates to an assembly employed for sealing and isolating predetermined areas in a well bore, and more particularly, but not by way of limitation, to an improved sealing apparatus for repairing breaches in a portion of a casing in the well bore.

2. Description of Prior Art

During the drilling of a well in the exploration of fluid minerals, such as oil and gas, a casing is secured in a well bore by a cement slurry which is injected between the exterior of the casing and the well bore. The casing functions to provide a permanent well bore of known diameter through which drilling, production or injection operations may be conducted; and the casing also provides the structure for attaching surface equipment required to control and produce fluids from the well bore or for injecting fluids therein. In addition, the casing prevents the migration of fluids between subterranean formations through the well bore, i.e., the intrusion of water into oil or gas formations or the pollution of fresh water by oil, gas or salt water.

Testing the mechanical integrity of the casing and the ability of the casing to isolate subterranean formations may be required for producing wells, and is mandated by law for injection and disposal wells. Casing which has been cemented in an injection or disposal well bore is required to pass a mechanical integrity test to assure that no breaches in the casing exists. If the casing fails the mechanical integrity test, the casing must be repaired. Mechanical integrity failure can result from various means, such as corrosion, old perforations, or other breaches in the casing including joint leaks, split casing or parted casing.

Mechanical integrity failures are normally repaired by either replacing the defective casing, cementing a new casing inside the old casing, or injecting cement into the breach of the casing which is commonly known as "squeeze cementing". Replacement of defective casing is often not feasible because of the initial completion method used and the risk in damaging additional casing because of stress imparted on the casing during such an operation. Because the operation of inserting a new casing inside the old casing is expensive, this option may not be economically feasible. Additionally, squeeze cementing is not always economically feasible, and is inappropriate for certain types and depths of subterranean formations. Furthermore, when squeeze cementing is utilized, satisfactory results are not always obtained. Finally, because of the amount of time required for these operations, each of these remedies are costly in terms of time that the well is out of service.

To avoid the expense and time associated with the above-mentioned remedies, sealing apparatus have heretofore been utilized for sealing and isolating casing at the point of the mechanical integrity failure. However, when employing the sealing apparatus of the prior art, problems have been encountered. For example, when employing the sealing apparatus of the prior art, the annular flow of fluids about a tubing string, which is formed of a plurality of tubing sections and tubing collars and extends through the sealing apparatus, is often restricted by the upset of the tubing string located between the tubing section and the tubing collar, thus producing a hydraulic braking effect. Further, the annular flow may be restricted during mechanical integrity testing which requires an annulus between the tubing string and the casing. Lastly, the sealing apparatus of the prior art is often ineffective because the resilient sealing elements become worn or deteriorate due to rough or cement-coated interior casing walls when the sealing apparatus is inserted into the well bore.

Thus, a need has long existed for an improved sealing apparatus which can provide substantially unrestricted annular fluid flow about the tubing string and which has greater durability, while remaining inexpensive and time efficient. It is to such an improved sealing apparatus that the present invention is directed.

SUMMARY OF THE INVENTION

The present invention relates to an improved sealing apparatus for repairing a breach of down hole casing integrity, while maintaining substantially unrestricted annular fluid communication through the length of the well bore. Broadly, the improved sealing apparatus of the present invention comprises a casing sleeve supported on a tubing string for providing an alternate fluid flow route about the tubing string at the defective portion of the casing. The casing sleeve is disposed between and connected to a first and second seal support housing assembly, each of which has an internal bore and a retaining end portion dimensioned to prevent a tubing collar of the tubing string from passing therethrough.

Resilient casing engaging members are supported on each of the first and second seal support housing assemblies such that the resilient casing engaging members provide an effective seal between the first and second seal support housing assemblies and an adjacently disposed internal wall of the casing. Thus, the resilient casing engaging members and the first and second seal support housing assemblies cooperate with the casing sleeve to seal and isolate a defective portion of the casing from pressure both inside and outside the casing.

The first and second seal support housing assemblies also having fluid communication slots disposed between the resilient casing engaging members and the retaining end portion of the first and second seal support housing assemblies to provide substantially unrestricted annular fluid communication about the tubing string which extends through the length of the well bore.

An object of the present invention is to provide an improved sealing apparatus for repairing a breach in a down hole casing.

Another object of present invention, while achieving the before-stated object, is to provide an improved sealing apparatus which permits substantially unrestricted fluid communication about a tubing string extending throughout the length of the well bore.

Another object of the present invention, while achieving the before-stated objects, is to provide an improved sealing apparatus adapted to support a predetermined number of casing engaging members to improve the durability and effectiveness of the sealing apparatus.

Still another object of the present invention, while achieving the before-stated objects, is to provide an improved sealing apparatus which is economical to manufacture, efficient in operation, and the use of which is time efficient.

Other objects, features and advantages of the present invention will become apparent from the following detailed description when read in conjunction with the drawings and appended claims.

DETAILED DESCRIPTION

Figure 1:
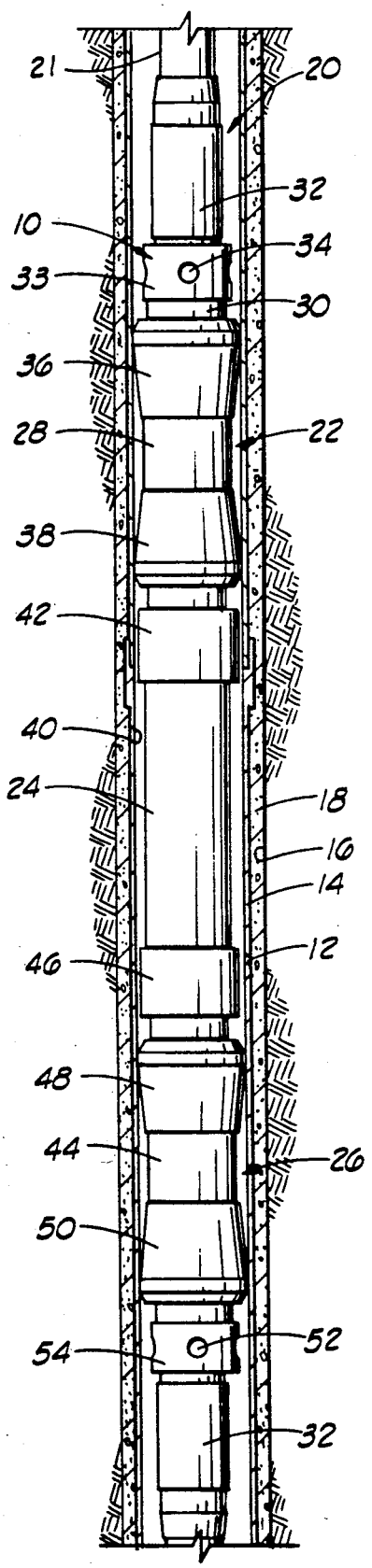
FIG. 1 PRIOR ART
FIG. 1 is a schematic illustration, partially in cross section, of a well bore having a casing secured thereto and illustrating a sealing apparatus constructed in accordance to the prior art, supported within the casing.

Referring now to the drawings, and more specifically to FIG. 1, a typical sealing apparatus 10 for repairing a breach 12 in a casing 14 affixed in a well bore 16 in a conventional manner, such as by cement 18, is illustrated. A tubing string 20 formed of a plurality of tubing sections 21 which are connected by tubing collars 32 extends through the casing 14 and thus the sealing apparatus 10 substantially as shown. The sealing apparatus 10 comprises a first sealing assembly 22, a casing sleeve 24, and a second sealing assembly 26. The first and second sealing assemblies 22, 26 are connected to opposed ends of the casing sleeve 24 such that when the sealing apparatus 10 is disposed within the casing 14 to repair the breach 12, the casing sleeve 24 provides an alternate flow route about the tubing string 20 at the breach 12 in the casing 14.

The first sealing assembly 22 comprises a first tubular housing 28 having a retaining end portion 30 which is dimensioned so as to prevent a tubing collar 32 of the tubing string 20 from passing through the first tubular housing 28, and thus the casing sleeve 24. A plurality of apertures, such as an aperture 34, is formed through a distal end portion 33 of the retaining end portion 30 of the first tubular housing 28 substantially as shown. Resilient casing engaging members 36, 38 are supported on the first tubular housing 28 so as to form a seal between the first tubular housing 28 and an internal wall 40 of the casing 14.

The first tubular housing 28 is connected to a first end 42 of the casing sleeve 24 such that fluid communication is established therebetween, while at the same time effectively providing a fluid-tight connection therebetween.

The second sealing assembly 26 of the sealing apparatus 10 is similar in construction to the first sealing assembly 22 and comprises a second tubular housing 44 connected to a second end 46 of the casing sleeve 24 such that fluid communication is established therebetween, while at the same time providing a fluid-tight connection. Resilient casing engaging members 48, 50 are supported on the second tubular housing 44 so as to provide a seal between the second tubular housing 44 and the internal wall 40 of the casing 14. A plurality of apertures, such as an aperture 52, is disposed in a distal end portion 54 of the second tubular housing 44.

The casing sleeve 24, in combination with the first and second tubular housings 28, 44, provide an internal bore along the portion of the casing 14 containing the breach 12 through which the tubing string 20 is passable. Further, the apertures 34 in the distal end portion 33 of the first tubular housing 28 and the apertures 52 in the distal end portion 54 of the second tubular housing 44 cooperate with an internal bore formed by the casing sleeve 24, the first tubular housing 28 and the second tubular housing 44 to provide a fluid flow passageway through the casing 14 around the breach 12.

When employing the sealing apparatus 10 of the prior art, have been encountered in that the dimensions of the upsets of tubing sections 21 are not API standard as are the dimensions of the tubing collars 32 and the tubing sections 21, thus the tubing collar 32 and the upset often closes off at least a portion of the paper in the retaining end portion 32 of the first tubular housing 28 when inserting the sealing apparatus 10 in the casing 14 which results in a hydraulic brake effect. This hydraulic brake effect often results in premature wear or deterioration of the resilient casing engaging members 36, 38 on the first tubular housing 28 and the resilient casing engaging members 48, 50 on the second tubular housing 44. Because of the problems encountered when employing the sealing apparatus 10 of the prior art to seal the breach 12 in the casing 14, a need for an improved sealing apparatus has long been recognized. However, such improved sealing apparatus must be capable of providing substantially unrestricted annular fluid flow about the portion of the tubing string extending through the sealing apparatus. Further, the construction of the sealing apparatus must be such that the resilient casing engaging members employed to provide the seal with the internal wall of the casing are durable and not subject to deterioration during positioning of the sealing apparatus within the casing.

Figure 2:
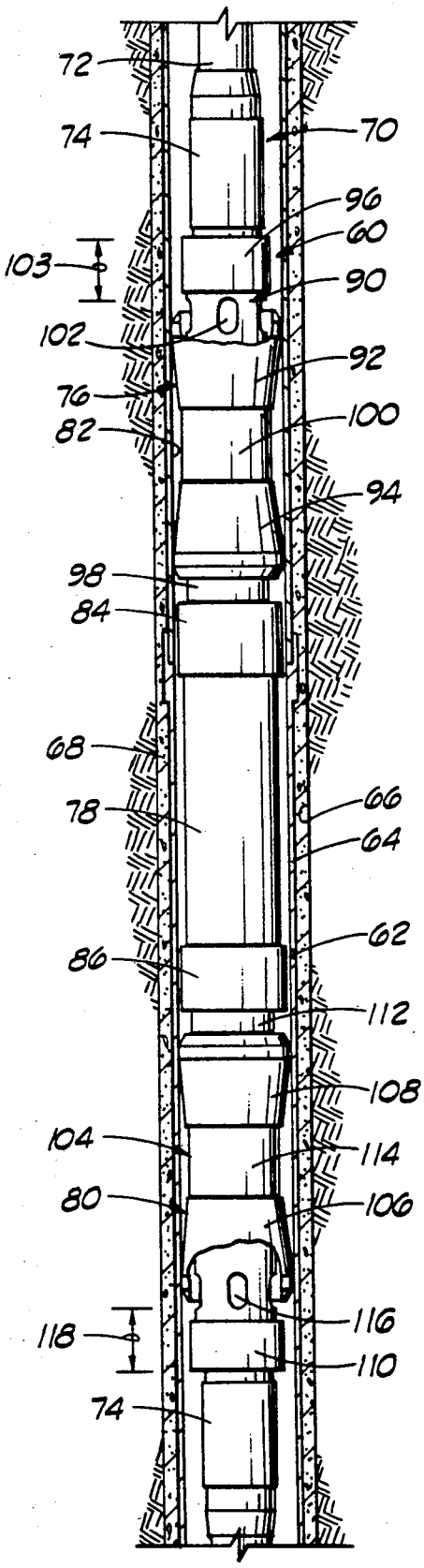
FIG. 2 is a schematic illustration, partially in cross section, of a well bore having a casing secured thereto and illustrating a sealing apparatus constructed in accordance to the present invention supported within the casing.

Referring now to FIG. 2, an improved sealing apparatus 60 constructed in accordance with the present invention is illustrated. The sealing apparatus 60 overcomes the beforementioned inherent deficiencies of the prior art sealing apparatus 10 (FIG. 1); and thus the sealing apparatus 60 represents an advance in the state of the art relating to repairing defective casing.

The sealing apparatus 60, which effectively repairs a breach 62 in a casing 64 secured in a well bore 66 with cement 68, is illustrated disposed within the casing 64. A tubing string 70, formed of a plurality of tubing sections 72 which are connected by tubing collars 74, extends through the casing 64 and thus the sealing apparatus 60.

The sealing apparatus 60 comprises a first sealing assembly 76, a casing sleeve 78 and a second sealing assembly 80. The casing sleeve 78 is supported on the tubing string 70 so as to provide an alternative fluid flow route about the tubing string 70 at the location of the breach 62 in the casing 64. The casing sleeve 78 is dimensioned so as to allow, a maximum fluid flow area between the casing sleeve 78 and a tubing section 72, typically the largest diameter casing sleeve 78 that will fit inside the casing 64.

The first and second sealing assemblies 76, 80, frictionally engage an interior wall 82 of the casing 64 so as to provide a seal with the casing 64 and prevent fluid communication external to the casing sleeve 78. Thus, the first sealing assembly 76 is connected and supported by one end 84 of the casing sleeve 78 and the second sealing assembly 80 is connected to and supported by a second end 86 of the casing sleeve 78 such that fluid communication is established therebetween and with the portions of the casing 64 disposed on each side of the sealing apparatus 60.

The first sealing assembly 76 comprises a first seal support housing 90 and a plurality of resilient casing engaging members, such as first and second resilient casing engaging members 92, 94. The first and second resilient casing engaging members 92, 94 are supported on the first seal support housing 90 so as to provide a seal between the first seal support housing 90 and the interior wall 82 of the casing 64.

The first seal support housing 90 is an elongated member having a first or retaining end portion 96, a second end portion 98 and an internal bore 100 through which a tubing section 72 is passable. The second end portion 98 of the first seal support housing 90 is connected to the first end 84 of the sleeve casing 78; and the retaining end portion 96 is dimensioned to prevent the tubing collars 74 from passing therethrough.

The first seal support housing 90 is provided with a plurality of fluid communication slots, such as fluid communication slot 102, so as to provide fluid communication between the casing 64 and the casing sleeve 78, and thus between the exterior of the tubing string 70 and the interior of the casing sleeve 78. The fluid communication slots 102 are positioned within the first seal support housing 90 a predetermined distance 103 from the retaining end portion 96 so that when one of the tubing collars 74 abuttingly engages the retaining end portion 96 of the first seal support housing 90, the tubing collar 74 and upset does not interfere or restrict flow of fluid through the fluid communication slots 102.

The second sealing assembly 80 comprises a second seal support housing 104 and a plurality of resilient casing engaging members, such as first and second resilient casing engaging members 106, 108. The first and second resilient casing engaging members 106, 108 are supported on the second seal support housing 104 and provide a seal between the second seal support housing 104 and the interior wall 82 of the casing 64. The second seal support housing 104 is an elongated member having a first or retaining end portion 110, a second, end portion 112 and an internal bore 114 through which a tubing section is passable. The second end portion 112 of the second seal support housing 104 is connected to the second end 86 of the sleeve casing 78; and the retaining end portion 110 is dimensioned to prevent the tubing collars 74 from passing therethrough.

The second seal support housing 104 is provided with a plurality of fluid communication slots, such as fluid communication slot 116, so as to provide fluid communication between the casing 64 and the casing sleeve 78, and thus between the exterior of the tubing string 70 and the interior of the casing sleeve 78. Thus, the fluid communication slots 116 in the second seal support housing 104 cooperate with the fluid communication slots 102 in the first seal support housing 90 so that continuous fluid flow is provided through the first and second seal support housings 90, 104 and the casing sleeve 78. Further, the fluid communication slots 116 are positioned within the second seal support housing 104 a predetermined distance 118 from the retaining end portion 110 of the second seal support housing 104 so that if one of the tubing collars 74 or upset is brought into abutting engagement or contact with the retaining end portion 110 of the second seal support housing 104, the and upset will not interfere with the flow of fluid through the fluid communication slots 116.

The first and second sealing assemblies 76, 80 are identical in construction, as are the first and second seal support housings 90, 104 and the first and second resilient casing engaging members 92, 94 and 106, 108 thereof. Thus, only the first sealing assembly 76, including the first seal support housing 90 and the first and second resilient casing engaging members 92, 94, will be described in detail hereinafter.

Figure 3:
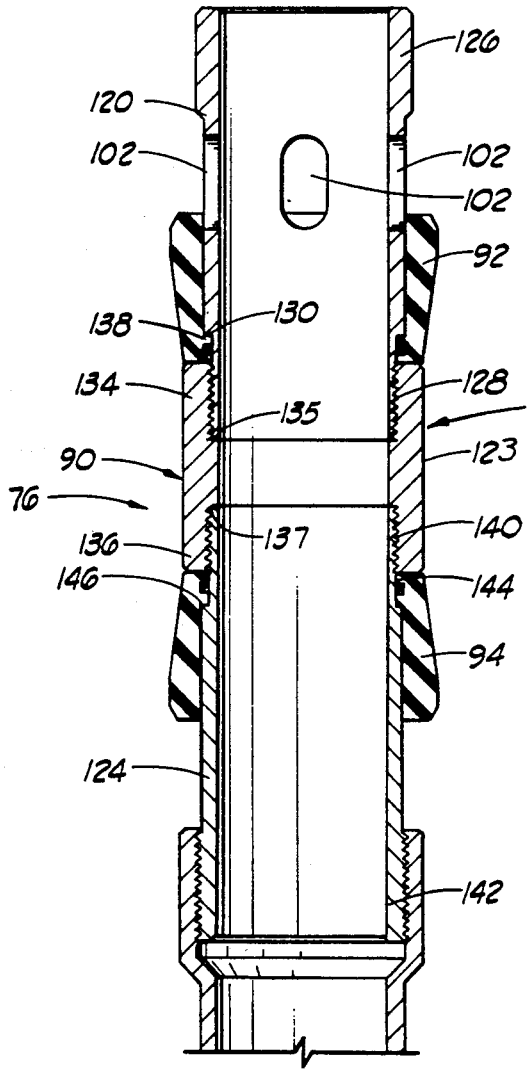
FIG. 3 is a cross-sectional view of an upper portion of the sealing assembly of the sealing apparatus of the present invention.
Figure 4:
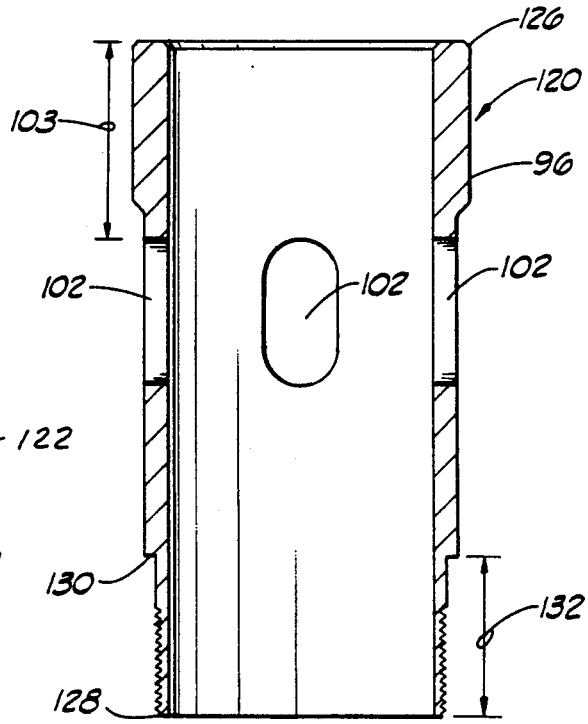
FIG. 4 is a cross-sectional view of a first tubular member of the sealing assembly of the present invention.
Figure 8:
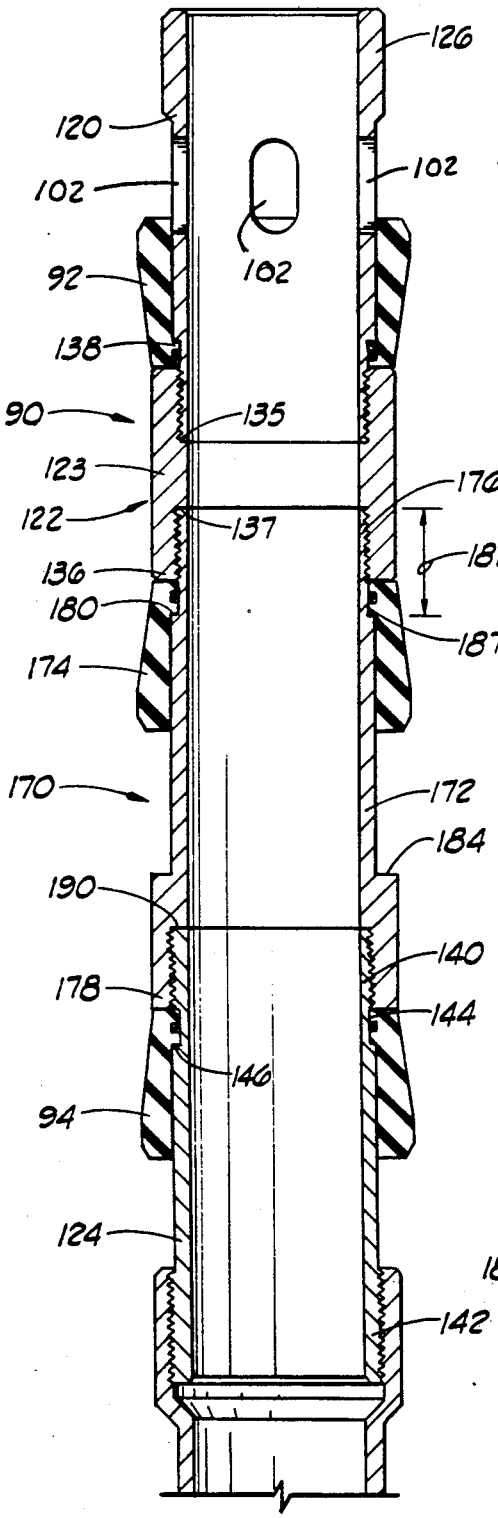
FIG. 8 is a cross-sectional view of an extension member of the coupling assembly of the sealing assembly of the present invention.

Referring now to FIGS. 3 and 8, the first seal support housing 90 of the first sealing assembly 76 comprises a first tubular member 120, a coupling assembly 122, and a second tubular member 124. The first tubular member 120 (see also FIG. 4) is provided with a first end portion 126 (which defines the retaining end portion 96 of the first seal support housing 90) and a second end portion 128. The fluid communication slots 102 are disposed in the side walls of the first tubular member 120 so as to be disposed the predetermined distance 103 (FIG. 4) from the first end portion 126 thereof. A support shoulder 130 is formed on the first tubular member 120 so as to be disposed a predetermined distance 132 from the second end portion 128 thereof.

Figure 5:
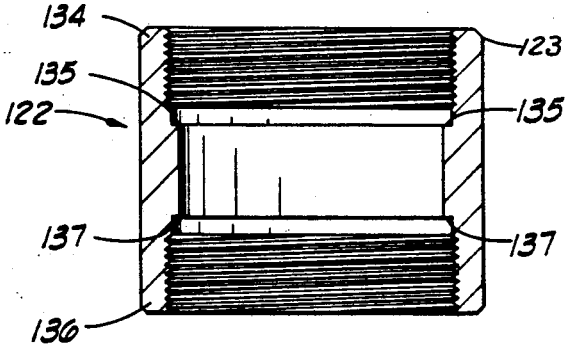
FIG. 5 is a cross-sectional view of a coupling member of a coupling assembly of the sealing assembly of the present invention.

The coupling assembly 122 includes a coupling member 123 (see also FIG. 5). The coupling member 123 is characterized as having a first end portion 134, an opposed second end portion 136 and internally disposed stop shoulders 135, 137. The first end portion 134 of the coupling member 123 is connected to the second end portion 128 of the first tubular member 120 by any suitable means, such as mating threads, so that fluid communication is provided between the first tubular member 120 and the coupling member 123. Further, upon connection of the first tubular member 120 to the coupling member 123, the first end portion 134 of the coupling member 123 cooperates with the support shoulder 130 on the first tubular member 120 to define a first annular recess 138 when the second end portion 128 of the first tubular member 120 abuttingly engages the stop shoulder 135 of the coupling member 123.

The second tubular member 124 (see also FIG. 6) is provided with a first end portion 140 and a second end portion 142. The first end portion 140 of the second tubular member 124 is connected to the second end portion 136 of the coupling member 123 (FIG. 3) so as to define a second annular recess 144 between a support shoulder 146 and the opposed second end portion 136 of the coupling member 123 when the first end portion 140 of the second tubular member 124 abuttingly engages the stop shoulder 137 of the coupling member 123. The second end portion 142 of the second tubular member 124 is connected to the first end 84 of the casing sleeve 78 by any suitable means, such as mating threads, so that a fluid-tight seal is formed therebetween.

Figure 6:
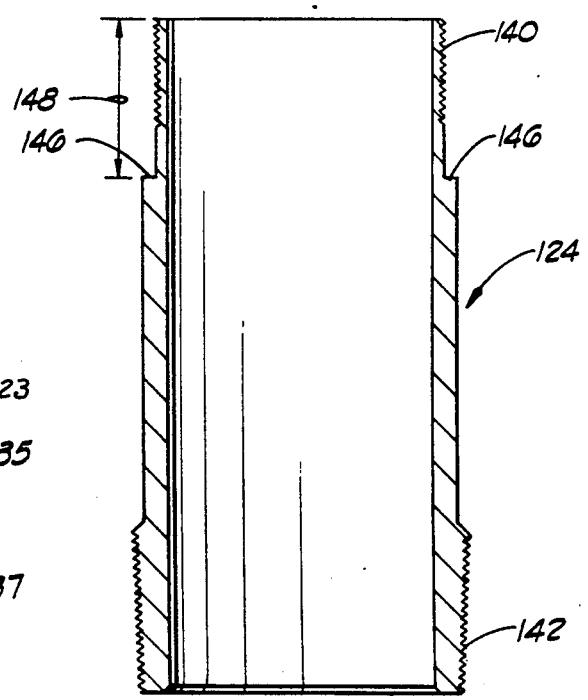
FIG. 6 is a cross-sectional view of the second tubular member of the sealing assembly of the present invention.

As shown in FIG. 6, the second support shoulder 146 is formed on the second tubular member 124 a predetermined distance 148 from the first end portion 140 thereof. Thus, in the sealing apparatus illustrated in FIG. 3 the support shoulder 130 on the first tubular member 120 cooperates with the first end portion of the coupling member 123 to define the first annular recess 138 and to secure the first resilient casing engagement member 92 to the first tubular member 120 of the first seal support housing 90; and the support shoulder 146 on the second tubular member 124 cooperates with the opposed second end portion 136 of the coupling member 123 to define the second annular recess 144 and to secure the second resilient casing engaging member 94 to the second tubular member 124 of the first seal support housing 90.

Figure 7:
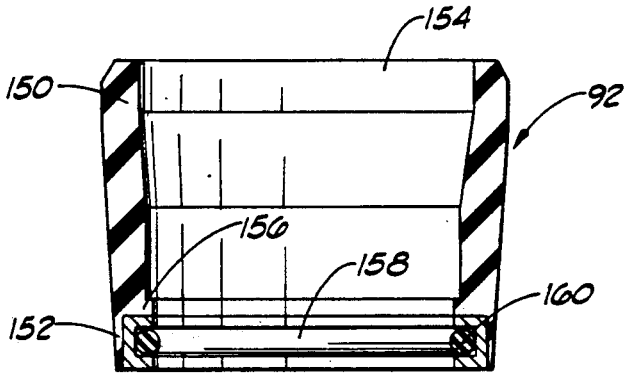
FIG. 7 is a cross-sectional view of a resilient casing engaging member of the sealing assembly of the present invention.

The first and second resilient casing engaging members 92, 94 supported on the first seal support housing 90 and the first and second resilient casing engaging members 106, 108 supported on the second seal support housing 104 (FIG. 2), are identical in construction. Thus, only the first resilient casing engaging member 92 will be described in detail with reference to FIG. 7.

The first resilient casing engaging member 92 is a substantially conically shaped member having a first end 150, an opposed second end 152, and a bore 154 extending therethrough adapted to receive the first tubular member 120 of the first seal support housing 90. An internally disposed shoulder 156 is formed near the opposed second end 152 of the first resilient casing engaging member 92. Thus, when the first resilient casing engaging member 92 is disposed on and supported by the first tubular member 120, the internally disposed shoulder 156 of the first resilient casing engaging member 92 abuttingly engages the support shoulder 130 of the first tubular member 120 and the opposed second end 152 of the first resilient casing engaging member 92 is supportingly disposed in the first annular recess 138 formed by the interconnection of the first tubular member 120 and the coupling member 123 (FIG. 3). Thus, the first resilient casing engaging member 92 is secured in a stable position on the first tubular member 120.

As previously stated, the second resilient casing engaging member 94 is identical in construction to the first resilient casing engaging member 92. Thus, the second resilient casing engaging member 94 is provided with an internally disposed shoulder formed near a first end thereof. The second resilient casing engaging member 94 is supported on the second tubular member 124 of the first seal support housing 90 by positioning the second resilient casing engaging member 94 thereon such that the internally disposed shoulder of the second resilient casing engaging member 94 abuttingly engages the support shoulder 146 of the second tubular member 124 and the opposed second end of the second resilient casing engaging member 94 is supportingly disposed in the second annular recess 144 formed by the interconnection of the coupling member 123 and the second tubular member 124 (FIG. 3). Thus, the second resilient casing engaging member 94 is secured to the second tubular housing 124 of the first seal support housing 90 in substantially the same manner as the first resilient casing engaging member 92 is secured to the first tubular member 120 of the first seal support housing 90.

The first resilient casing engaging member 92 is further provided opposed second end 152 thereof and the internally disposed shoulder 156. An O-ring 160 is positionable within the internally disposed groove 158 and adapted to frictionally engage the first tubular member 120 so as to enhance the forming of a fluid-tight seal between the first resilient casing engaging member 92 and the first tubular member 120. Similarly, the second resilient casing engaging member 94 is provided with an internally disposed groove identical to the internally disposed groove 158 of the first resilient casing engaging member 92 which is adapted to also receive an O-ring in order to provide a substantially fluid-tight seal between the second resilient casing engaging member 94 and the second tubular member 124.

Figure 9:
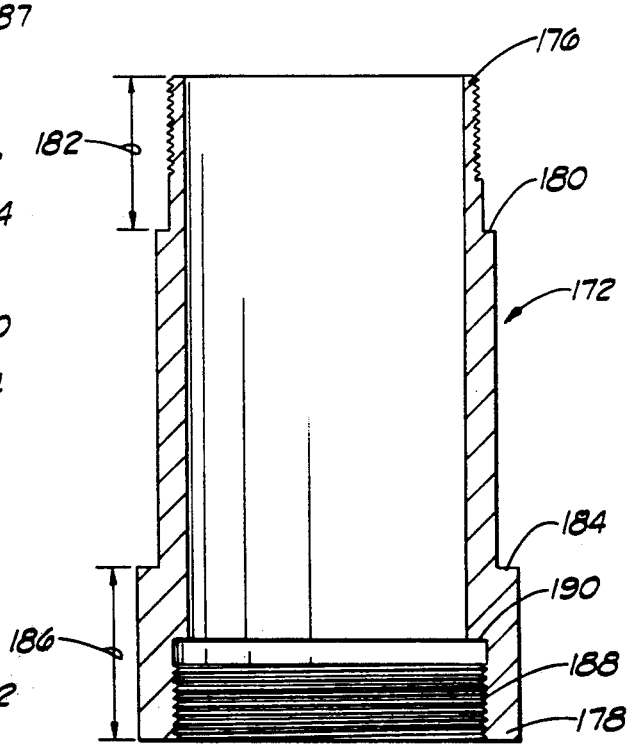
FIG. 9 is a cross-sectional view of the extension member of a sealing assembly of FIG. 8.

When repairing breaches in a portion of the casing in the well bore it may be desirable to increase the overall effective length of the sealing apparatus 60, as well as to enhance the ability of the sealing apparatus 60 to provide an effective seal with the casing. Such can readily be accomplished by incorporating an extension housing assembly 170 of the coupling assembly 122 into the sealing apparatus 60 such that the extension housing assembly 170 is disposed between the coupling member 123 and the second tubular member 124. As previously mentioned, the first seal support housing 90 is identical in construction to the second seal support housing 104. Thus, only the tubular extension member 172 incorporated into the first seal support housing 90 will be discussed in detail with reference to FIGS. 8 and 9.

The extension housing assembly 170 of the seal support housing 90 comprises a tubular extension member 172 and a third resilient casing engaging member 174 supported thereon. The tubular extension member 172 is provided with a first end portion 176 and an opposed second end portion 178. A first support shoulder 180 is formed on the tubular extension member 172 a predetermined distance 182 from the first end portion 176; and a second support shoulder 184 is formed on the tubular extension member 172 a predetermined distance 186 from the opposed second end portion 178. The first end portion 176 of the tubular extension member 172 is connected to the opposed second end portion 136 of the coupling member 122 by any suitable means such as mating threads. Upon connection of the tubular extension member 172 to the coupling member 122, the first support shoulder 180 of the tubular extension member 172 cooperates with the second end portion 136 of the coupling member 122 to define a third annular recess 187 when the first end portion 176 of the tubular extension member 172 abuttingly engages the stop shoulder 137 of the coupling member 122. The first support shoulder 180 formed on the first end portion 176 of the tubular extension member 172 cooperates with the third annular recess 187 to secure the third resilient casing engaging member 174 thereon.

The opposed second end portion 178 of the tubular extension member 172 is provided with internally disposed threads 188 adapted to matingly engage the threaded first end portion 140 of the second tubular member 124. An internally disposed stop shoulder 190 is formed within the opposed second end portion 178 of the tubular extension member 172 substantially as shown. Thus, on connection of the first end portion 140 of the second tubular member 124 to the opposed second end portion 178 of the tubular extension member 172, the first end portion 140 of the second tubular member 124 abuttingly engages the internally disposed stop shoulder 190 formed in the opposed second end portion 178 of the tubular extension member 172; and the support shoulder 146 of the second tubular member 124 and the opposed second end portion 178 of the tubular extension member 172 cooperate to define the annular recess 144 for securing the second resilient casing engaging member 94 to the tubular extension member 172.

From the foregoing description it becomes apparent that the unique design and construction of the sealing apparatus 60 of the present invention overcomes many of the inherent defects of the prior art apparatus, as well as methods heretofore employed for repairing breaches in casing secured in a bore hole. Further, it will be clear that the present invention is well adapted to carry out the objects and to attain the ends and advantages mentioned as well as those inherent therein. While a presently preferred embodiment has been described for purposes of this disclosure, numerous changes may be made which will readily suggest themselves to those skilled in the art and which are encompassed within the spirit of the invention disclosed and as defined in the appended claims.

What is claimed is:

1. A sealing apparatus for repairing a breach of casing integrity in a well bore having a casing affixed therewith and a tubing string extending therethrough, the tubing string made up of tubing sections connected by tubing collars, the sealing apparatus comprising:

casing sleeve means supported on the tubing string for providing an alternate fluid flow route about the tubing string at a defective portion of the casing; and first and second sealing means for sealing against fluid communication external to the casing sleeve means, each of the first and second sealing means supported at one end of the casing sleeve means and comprising:

a seal support housing having one end portion attachable to the casing sleeve means and an opposing retaining end portion dimensioned to prevent a tubing collar from passing therethrough, the seal support housing having an internal bore through which a tubing section is passable and at least one fluid communication slot disposed a predetermined distance from the retaining end portion so as to provided substantially unrestricted annular fluid flow about the tubing string, the seal support housing comprising:

a first tubular member having a first end portion, a second end portion and a support shoulder, the support shoulder disposed a predetermined distance from the second end portion thereof;

a second tubular member having a first end portion, a second end portion and a support shoulder, the support shoulder disposed a predetermined distance from the first end portion thereof; and coupling means for coupling the first tubular member to the second tubular member, such that a first annular recess is formed between the support shoulder of the first tubular member and the coupling means and a second annular recess is formed between the support shoulder of the second tubular member and the coupling means, the coupling means comprising:

a coupling member having a first end portion and a second end portion, the first end portion of the coupling member connected to the second end portion of the first tubular member such that fluid communication is provided therebetween, the opposed second end portion of the coupling member connected to the first end portion of the second tubular member such that fluid communication is provided therebetween; and at least one extension member having a first end portion, a second end portion and an internally disposed bore extending therebetween, the first end portion of the extension member having a support shoulder disposed a predetermined distance from the first end thereof, the opposed second end of the extension member cooperating with the support shoulder of the second tubular member for defining of the second annular recess, the support shoulder of the extension member cooperating with the opposed second end portion of the coupling member to define a third annular recess; and casing engaging means supported by the seal support housing for providing a seal between the seal support housing and the internal wall of the casing, the casing engaging means comprising:

a first resilient casing engaging member having a first end, an opposed second end and an internally disposed shoulder formed near the first end thereof, the internally disposed shoulder supported within the first annular recess and the opposed second end adapted to supportingly engage the first end portion of the coupling member so that the first resilient casing engaging member is secured in a stable position on the first tubular member;

a second resilient casing engaging member having a first end, an opposed second end and an internally disposed shoulder formed near the opposed second end, the internally disposed shoulder supported within the second annular recess and the opposed second end of the second resilient casing engaging member adapted to supportingly engage the second end portion of the coupling member so that the second resilient casing engaging member is secured in a stable position on the second tubular member; and a third resilient casing engaging member having a first end, an opposed second end and an internally disposed shoulder formed near the first end thereof, the internally disposed shoulder of the third resilient casing engaging member supported within the third annular recess such that the opposed second end thereof abuttingly engages the second end portion of the coupling member, wherein the first, second and third resilient casing engaging members are each provided with an internally disposed groove between the opposed second end and the internally disposed shoulder thereof, and wherein the casing engaging means further comprises an O-ring member positionable within the internally disposed groove of the first, second and third resilient casing engaging members.

2. A sealing apparatus for repairing a breach of casing integrity in a well bore having a casing affixed therewith and a tubing string extending therethrough, the tubing string made up of tubing sections connected by tubing collars, the sealing apparatus comprising:

casing sleeve means supported on the tubing string for providing an alternate fluid flow route about the tubing string at a defective portion of the casing; and first and second sealing means for sealing against fluid communication external to the casing sleeve means, each of the first and second sealing means supported at one end of the casing sleeve means and comprising:

a seal support housing having one end portion attachable to the casing sleeve means and an opposing retaining end portion dimensioned to prevent a tubing collar from passing therethrough, the seal support housing having an internal bore through which a tubing section is passable and at least one fluid communication slot disposed a predetermined distance from the retaining end portion so as to provided substantially unrestricted annular fluid flow about the tubing string, the seal support housing comprising:

a first tubular member having a first end portion, a second end portion and a support shoulder, the support shoulder disposed a predetermined distance from the second end portion thereof;

a second tubular member having a first end portion, a second end portion and a support shoulder, the support shoulder disposed a predetermined distance from the first end portion thereof; and coupling means for coupling the first tubular member to the second tubular member, such that a first annular recess is formed between the support shoulder of the first tubular member and the coupling means and a second annular recess is formed between the support shoulder of the second tubular member and the coupling means, the coupling means comprising:

a coupling member having a first end portion and an opposed second end portion, the first end portion of the coupling member connected to the second end portion of the first tubular member and the first end portion of the coupling member cooperating to define a first annular recess therebetween; and an extension member having a first end portion, an opposing second end portion and a support shoulder formed a predetermined distance from the first end portion thereof, the first end portion of the extension member connected to the second end portion of the coupling member so as to provide fluid communication therebetween, the support shoulder of the extension member cooperating with the opposed second end portion of the coupling member to define a third annular recess therebetween, the opposed second end portion of the extension member connected to the first end portion of the second tubular member such that the second support shoulder of the second tubular member and the opposed second end portion of the extension member define the second annular recess therebetween; and casing engaging means supported by the seal support housing for providing a seal between the seal support housing and the internal wall of the casing.

3. The sealing apparatus of claim 2 wherein the casing engaging means comprises:

a first resilient casing engaging member having a first end, an opposing second end and an internally disposed shoulder formed near the opposed second end, the internally disposed shoulder supported within the first annular recess and the opposed second end of the first resilient casing engaging member adapted to supportingly engage the first end portion of the coupling member so that the first resilient casing engaging member is secured in a stable position on the first tubular member;

a second resilient casing engaging member having a first end, an opposed second end and an internally disposed shoulder formed near the first end thereof, the internally disposed shoulder of the second resilient casing engaging member supported within the second annular recess formed between the support shoulder of the second tubular member and the opposed second end portion of the extension member, the opposed second end of the second resilient casing engaging member adapted to supportingly engage the opposed second end portion of the extension member; and a third resilient casing engaging member having a first end, an opposed second end and an internally disposed shoulder disposed near the first end thereof, the internally shoulder of the third resilient casing engaging members supported within the third annular recess formed between the support shoulder of the extension member and the opposed second end portion of the coupling member, the opposed second end of the third resilient casing engaging member supportingly engaging the opposed second end portion of the coupling member so that the third resilient casing engaging member is secured in a stable position on the extension member.

* * * * *

UNITED STATES PATENT AND TRADEMARK OFFICE

CERTIFICATE OF CORRECTION

PATENT NO. : 5,195,584

DATED : March 23, 1993

INVENTOR(S) : Albert E. Basinger, Jr.

It is certified that error appears in the above-identified patent and that said Letters Patent is hereby corrected as shown below:

Cover Sheet - [57] Abstract, line 1, after "An improved sealing" insert --apparatus--; and Column 6, line 11, after the second occurrence of "the" insert --tubing collar 74--.

Signed and Sealed this

Eighth Day of March, 1994

Bruce Lehman

*Attest:*

BRUCE LEHMAN

*Attesting Officer*

*Commissioner of Patents and Trademarks*